US005971036A

United States Patent [19]

Rehmer et al.

[11] Patent Number: 5,971,036

[45] Date of Patent: Oct. 26, 1999

[54] FILLING AND EMPTYING OF STORAGE TANKS CONTAINING AQUEOUS DISPERSIONS

[75] Inventors: Gerd Rehmer, Beindersheim; Walter Holtrup, Frankenthal, both of Germany

[73] Assignee: BASF Aktiengesellschaft, Ludwigshafen, Germany

[21] Appl. No.: 09/060,104

[22] Filed: Apr. 15, 1998

[51] Int. Cl.[6] ..... B65B 1/04

[52] U.S. Cl. ..... 141/1; 137/577; 137/578; 137/592

[58] Field of Search ..... 141/1, 2, 5, 18, 141/67, 94, 95, 96, 114, 250, 279, 284; 137/577, 578, 592

[56] References Cited

U.S. PATENT DOCUMENTS

| | | | |
|---|---|---|---|
| 1,115,791 | 11/1914 | Drew | 137/592 |
| 1,668,793 | 5/1928 | Wiggins . | |
| 5,640,994 | 6/1997 | Jacobsen | 137/592 |

FOREIGN PATENT DOCUMENTS

| | | |
|---|---|---|
| 1 457 558 | 6/1966 | France . |
| 1 550 616 | 11/1968 | France . |
| 1 207 900 | 10/1970 | United Kingdom . |

OTHER PUBLICATIONS

Wolfgang Siegert, "Keimen Keine Chance Lassen," Farbe & Lack, vol. 99, No. 1, (1993), pp. 37–39.

Hans–Curt Flemming, "Biofouling und Biokorrosion—Die Folgen unerwuenschter Biofilme," Chemie Ingenieur Technik, 67, (Nov. 1995), pp. 1425–1430.

J. W. Gillatt, "The Microbiological Spoilage of Emulsion Paints During Manufacture and Its Prevention," Jocca, 9, (1991), pp. 324–328.

*Primary Examiner*—Steven O. Douglas
*Assistant Examiner*—Timothy L. Maust
*Attorney, Agent, or Firm*—Oblon, Spivak, McClelland, Maier & Neustadt, P.C.

[57] ABSTRACT

A method of filling and emptying storage tanks containing aqueous dispersions, where the storage tank is emptied via a line whose opening is located in the lower section of the storage tank entails filling the storage tank with a line whose outlet follows the changes in the level of the liquid surface in the course of filling and removal procedures, the level of the outlet being adjusted such that the opening is located approximately at the height of the level of the liquid.

11 Claims, 3 Drawing Sheets

FIG.2A
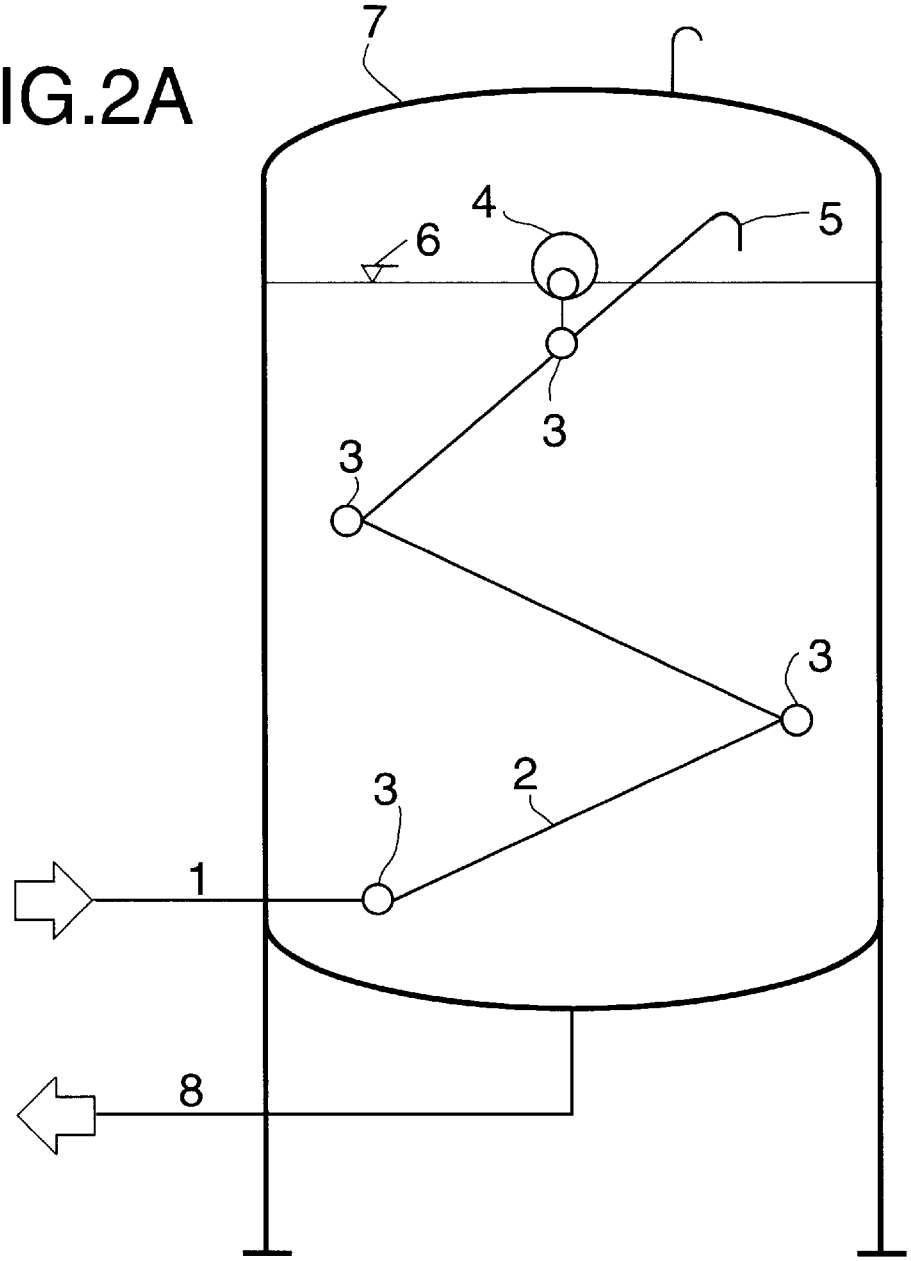
FIG.2B
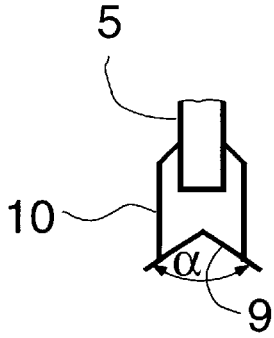
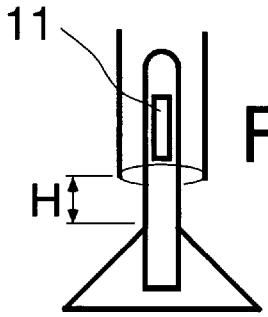
FIG.2C

FILLING AND EMPTYING OF STORAGE TANKS CONTAINING AQUEOUS DISPERSIONS

FIELD OF THE INVENTION

The present invention relates to an improved method of filling and emptying storage tanks containing aqueous dispersions, in which the storage tank is emptied via a line whose opening is located in the lower part of the storage tank.

BACKGROUND OF THE INVENTION

Aqueous polymer dispersions as used for a host of applications, for example in the coatings and adhesive industries, etc., are required to be of high quality. One parameter of this quality is their keeping properties.

The keeping properties of dispersions are enhanced by the addition of preservatives and, in particular, by means of hygiene measures.

In storage it must be ensured in particular that the dispersion is not over-stored. Here, one of the critical factors is the way in which the storage tanks are filled and emptied.

Procedures to date have used the same line to fill and empty the storage tanks. If this line is attached in the base of the storage tank, the top layer of the dispersion wanders up and down in the course of the filling and removal operations, and becomes older and older, with all of the consequences of possible infestation by microorganisms as a result of excessive aging.

Another procedure uses a filling line which enters at the top of the storage tank and whose outlet is generally positioned toward the wall. The emptying line is judiciously located on the base of the storage tank. Although this procedure does some justice to the FIFO ("first in—first out") principle, filling from the top may lead to the formation of deposits on the walls and to unwanted foaming. Wall deposits are similarly undesirable because the deposit grows and can become the focus of nucleation. Foaming is undesirable because the foam readily dries and leads to the formation of gel specks (nonredispersible coagulum) in the product.

The problem of the filling and emptying of storage tanks and the storage of products which may be damaged by infestation with microorganisms is addressed in an article in the journal Farbe & Lack, Vol. 99, No. 1, 1993, pages 37–39 ff. The unwanted microbial growth is brought about in particular by the constituents of the dispersion and the water component, and the addition of preservatives—referred to as biocides—is recommended for reducing this growth.

In order to be able to store high-quality products reliably it is necessary to adopt the FIFO principle. This means that the parts of product first introduced into the storage tank are, in the course of subsequent removal, the first to be withdrawn, in order to avoid excessive aging of parts of the product.

In order to minimize these problems, stirred storage tanks have been proposed. Stirred storage tanks, however, are expensive and maintenance-intensive. Relatively large storage tanks whose contents are to be mixed by stirring must be provided with special reinforcement. Here too there may be instances of drying on the stirrer shaft or stirrer blades. Stirring may also introduce air into the dispersion, which is undesirable.

BRIEF SUMMARY OF THE INVENTION

It is an object of the present invention, therefore, to find an improved method of filling and emptying storage tanks which remedies the above disadvantages and enables aqueous dispersions to be stored in a technically simple and economic manner. A particular aim is to ensure permanently the high quality of the aqueous dispersion present in the storage tank and to prevent damage to the technical equipment, as may occur by biocorrosion or biofouling. This problem is addressed in Chemie Ingenieur Technik (67), 11/95, pages 1425–1430.

We have found that this object is achieved by a method of filling and emptying storage tanks containing aqueous dispersions, where the storage tank is emptied via a line whose opening is located in the lower part of the storage tank, which comprises filling the storage tank using a line whose outlet follows the changes in level of the surface of the liquid in the course of filling and removal procedures, the level of the outlet being adjusted such that the opening is located approximately at the height of the level of the liquid.

BRIEF DESCRIPTION OF THE DRAWINGS

FIGS. 1 to 3 show exemplary arrangements in accordance with the invention.

In FIG. 1 a filling line of a storage tank is connected to a float trunk which has a plurality of rotary joints. The float is at the end of the float trunk, and the outlet is a little way below the surface of the liquid.

FIG. 2*a* shows a similar arrangement. In this case, however, the outlet is above the surface of the liquid.

FIG. 2*b* a baffle mounted by means of struts is placed at the outlet.

FIG. 2*c* shows a baffle whose distance from the outlet can be adjusted by means of a slot.

FIG. 3 shows a similar arrangement in which a flexible line is employed which is controlled by means of an eye and a guide cable which is stretched through fixing eyes.

DETAILED DESCRIPTION OF THE PREFERRED EMBODIMENTS

Figure 1:
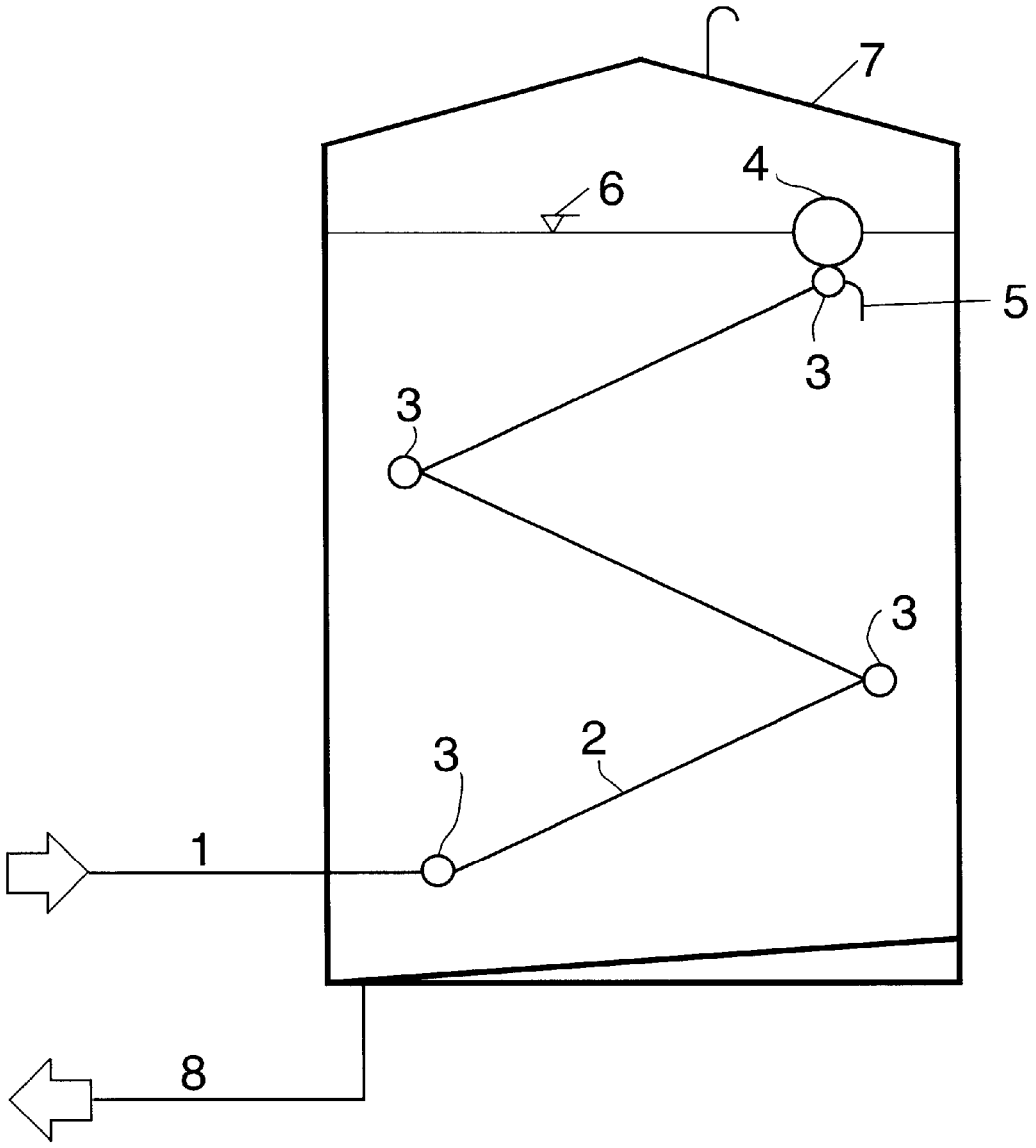

The novel method makes it possible, advantageously, to deal with the stored aqueous dispersions in accordance with the FIFO principle.

During filling, new product is introduced close to the surface and, during removal, product is withdrawn from the lower part of the storage tank. The result, advantageously, is a layering of the product such that the parts of product which have already been stored the longest are located close to the removal side and are the next to be withdrawn, and, correspondingly, newly added parts of product are added at the surface virtually as a new surface layer.

The method is particularly suitable in connection with the use of unstirred storage tanks. The additional expenditure incurred by stirring apparatus can therefore be avoided, and at the same time the high quality of the stored aqueous dispersion is ensured.

Particularly suitable for the novel method are float trunks, also referred to as float aspirators or suction float trunks, for filling the storage tank. These float trunks usually consist of flexible or rigid elements which are connected to one another flexibly via one or more rotary joints, thereby enabling alteration in length in a manner similar to that of the scissors principle.

Float trunks of this kind are already known and are marketed, for example, by the companies Emco in Kirchhain, Connex in Kamen and Schwelm in Schwelm.

Such float trunks have to date only been employed for emptying purposes, for example in the removal under suction of the liquid phase from settling tanks or oil tanks.

The novel use of such float trunks for filling storage tanks has not been disclosed.

The use of such float trunks in the case of the filling of storage tanks with aqueous dispersions would not have been considered by the skilled worker, who would have feared the sticking of the rotary joints of the float trunks by the dispersion. Furthermore, the combination of the novel filling by means of the float trunk and the removal from the lower part of the storage tank achieves the advantageous layering of the product as set out above.

By attaching a buoy, the outlet of the filling line is able advantageously to follow, as it floats, the changes in the level of the liquid.

By means of buoys of different size it is possible to change the buoyancy. Advantageously, however, use is made of fillable floats which are filled with, say, water, diethylene glycol or other materials, such as metal balls, and are equalized to adapt them to the density of the stored product. In this way it is possible advantageously, moreover, to alter the depth of immersion of the filling line and to optimize it to the particular product. The floats can in principle have any desired geometric forms. Preference is given to spherical floats or to conical floats whose tapered end dips into the dispersion, and these floats may be arranged in pairs. Hollow stainless steel bodies are particularly preferred. In general, the float trunk will be held by one or two floats.

The emptying of the storage tanks takes place conventionally, furthermore, from below.

The equalization of the float or floats and thus the depth of immersion of the end of the filling line makes it possible, advantageously, to fill the storage tanks in a substantially foam-free operation, thereby avoiding the drying of foam and the formation of coagulum.

By virtue of this mode of filling of unstirred storage tanks, the freshly produced product passes "from above" into the storage tank, avoiding the abovementioned disadvantages.

As a result of the emptying of the storage container "from below" it is the older product which is removed for sale. The desired FIFO principle is largely observed.

Flexible filling lines which can be used are all flexible hoses resistant to the medium.

Suitable floats are hollow bodies made from various materials, for example plastic (polypropylene, polyethylene) or stainless steel (grade V2A, V4A), or else rubberized or coated steel containers. Also suitable are floats made from coated or uncoated, foamed plastics. The simplest embodiment comprises plastic drums with a closed lid. The float is preferably connected deflectably to the filling line. In general, the float is flexibly connected to the end of the filling line, although the filling line may also pass through the float.

The outlet of the filling line is advantageously located just below the surface of the liquid, preferably from about 50 to 200 mm below the level of the liquid, and the outlet can have a cross-sectional area corresponding to one or more times the cross section of the filling line. Alternatively, the outlet of the filling line can be located just above the surface of the liquid, the height being chosen so that the undesirable foaming does not occur. Foaming is also dependent, however, on the cross section of the filling line and on the volume flow of the dispersion with which the storage tank is filled; the diameter of the filling line is preferably from 50 to 200 mm, particularly preferably from 80 to 150 mm, or is 100 mm. The geometrical configuration of the outlet, filling below or above the level of the liquid, and the volume flow are the parameters which can be optimized for each specific product by means of routine experiments.

Preferred positions of the outlet depend, inter alia, on the viscosity and foaming propensity of the dispersion used.

In the case of dispersions of relatively high viscosity (greater than about 2000 mpas) it is advisable, for example, not to position the opening a long way below the level of the liquid, since in this case there might be no product exchange at the. surface and thus the desired FIFO principle would not be fulfilled.

The outlet can be altered by means of routine experiments; for example, a plurality of openings, produced by means including forks and branches, is possible.

The outlet is preferably located in the center of the level of the liquid in order to allow uniform propagation of the dispersion in all directions.

In one preferred embodiment the outlet is fastened to the end of the float trunk via a rotary joint in such a way that the cross-sectional area of the opening is parallel to the level of the liquid.

The outlet can, for example, exhibit a bell-like widening. It is possible, preferably, for a baffle to be mounted before the outlet, by means of which the stream of product is fanned out and is distributed better over the surface. This baffle is preferably height-adjustable and is fastened to the end of the filling line by means, for example, of screw connections.

This filling and removal technique for unstirred storage containers means that older product is passed for sale even earlier. Consequently, the FIFO principle, which is favorable from the standpoint of hygiene, is very largely fulfilled.

Judiciously, particular preference is given to vertical, cylindrical storage tanks, although storage tanks with a square, rectangular or oval cross section can also be employed. Similarly, it is also possible advantageously to operate horizontal containers, cylindrical or rectangular in form, in the described manner. Cylindrical storage tanks are advantageously used, with the diameter being chosen such that in the course of filling the propagating dispersion spreads to the walls. Use is made, advantageously, of vertical, cylindrical storage tanks, wherein the proportion of the internal diameters of the storage tanks relative to the diameter of the filling line is within a range from 10 to 120, preferably from 20 to 50.

The storage containers are generally filled and emptied by pumping the dispersions. If required, the filling and emptying lines can advantageously be designed so as to be piggable.

Figure 3:
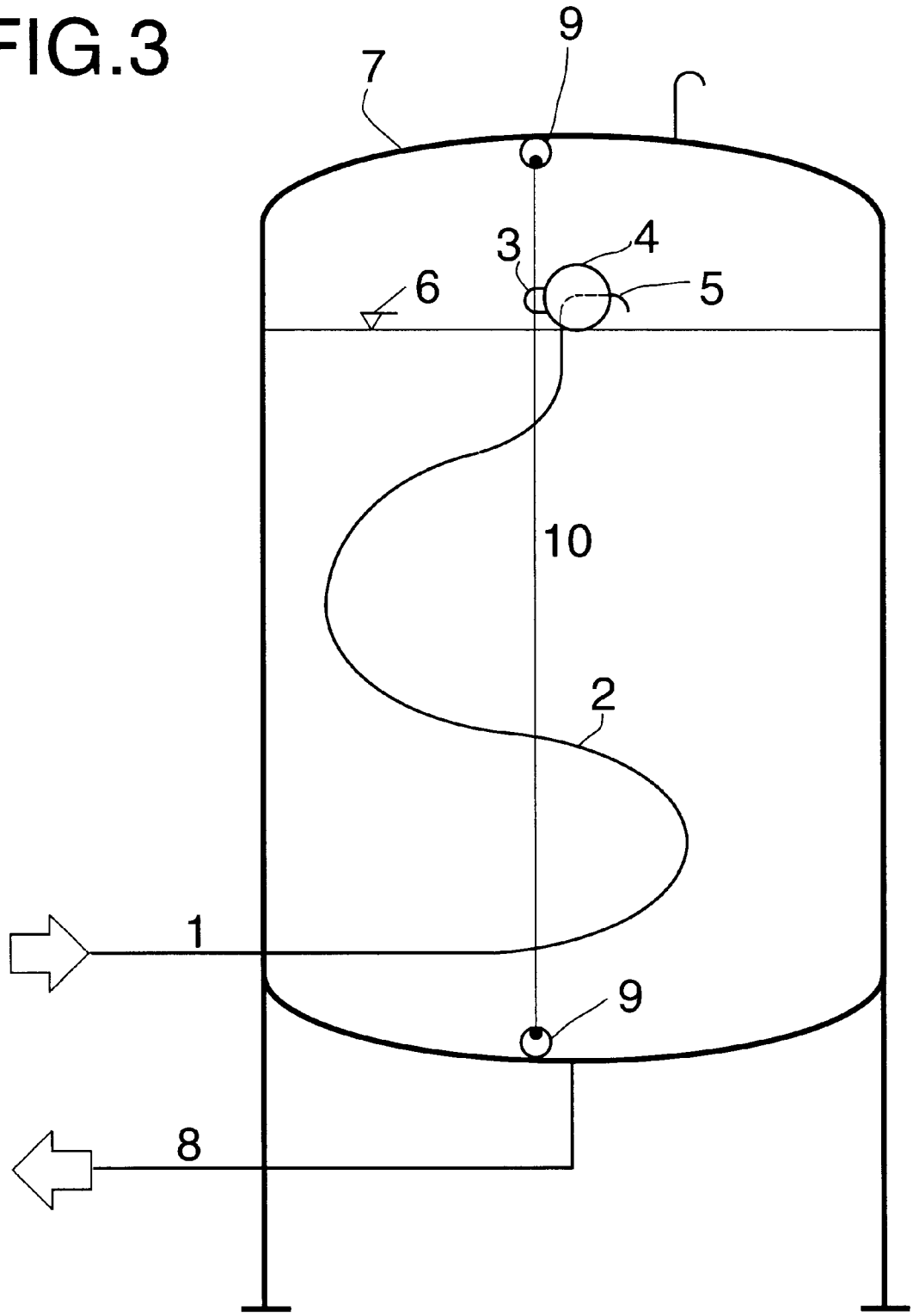

FIGS. 1 to 3 show exemplary arrangements in accordance with the novel method.

In FIG. 1 the filling line (1) of a storage tank (7) is connected to a float trunk (2) which has a plurality of rotary joints (3). The float (4) is at the end of the float trunk, and the outlet (5) is a little way below the surface of the liquid (6).

The base of the storage tank is designed with a gradient so that the liquid passes to the removal line (8).

FIG. 2*a* shows a similar arrangement. In this case, however, the outlet (5) is above the surface of the liquid (6).

FIG. 2*b* a baffle (9) mounted by means of struts (10) can be placed at the outlet (5).

The angle $\alpha$ can be optimized by means of routine experiments in order to obtain effective and uniform spreading of the dispersion during filling.

FIG. 2*c* shows a baffle whose distance H from the outlet can be adjusted by means of the slot 11.

In order to avoid dead spaces when using this baffle, the baffle may have one or more holes. It can also be manufactured from perforated sheet metal.

Preferred designs of the baffle can be determined by the skilled worker using routine experiments. In selecting the angle α, the diameter of the storage tank and the viscosity and foaming propensity of the dispersion are particularly important factors.

FIG. 3 shows a similar arrangement in which a flexible line (2) is employed which is controlled by means of an eye (11) and the guide cable (10) which is stretched through the fixing eyes (9).

In this example the outlet (5) is above the level of the liquid (6).

All aqueous polymer dispersions can be stored in accordance with the novel method.

This mode of storage is particularly advantageous if the dispersions are given no preservative or a relatively low concentration of preservative. This occurs, for example, in the case of interim storage of the dispersions before further processing. Such preservatives are described, for example, in JOCCA, 1991 (9), pages 324–328.

Examples of suitable preservatives are formulations of 1,2-benzisothiazolin-3-one sodium salts in a mixture of water and propylene glycol, for example Proxel XL2 from ICI, formulations of biocidal (chloro)isothiazolones, for example-Aktizid LA from THOR CHEMIE GmbH, Kathon LX plus from ROHM & HAAS. Aqueous dispersions which can advantageously be stored in the manner described above are, for example, dispersions based on ethylenically unsaturated compounds, such as those based, for example,. on (meth)acrylates, butadiene, styrene, vinyl acetate, (meth) acrylamide, acrylonitrile, (meth)acrylic acid, etc. Dispersions of this kind are known.

The dispersions may be fully formulated. The aqueous dispersions may have the character of precursors, or may be.already present as ready-to-use products, for example in pigmented form for coating purposes.

Examples of further formulating agents are diols such as butyl glycol, butyl diglycol, diethylene glycol, alcohols, for example ethanol, isopropanol and 1-octadecanol, solvents, such as Lusolvan FBH (BASF AG), complexing agents, based for example on ethylenediaminetetraacetic acid, eg. Trilon B Flüssig (BASF AG), synthetic resin solutions, for example aqueous solutions of polyvinyl methyl ethers, eg. Lutonal M 40 (BASF AG), solutions of ammonium polyacrylates, eg. Collacral P (BASF AG), plasticizers, for example dibutyl phthalate, eg. Palatinol C (BASF AG), anionic dispersions of montan ester wax, eg. Gleitmitteldispersion 8645 (BASF AG), chemical compounds such as urea and ethyleneurea, sodium hydroxide solution, potassium hydroxide solution, ammonia, calcium hydroxide, zinc nitrate, zinc oxide, emulsifiers, for example alkylphenol ethoxylates, eg. Emulgator 825 (BASF AG), block copolymers based on propylene oxide and ethylene oxide, antifoams, eg. Dapro DF 900 from KRAHN CHEMIE GmbH and Byk-033 from BYK-CHEMIE GmbH, Wesel, Nopo 8034 E/D from HENKEL KGaA, compounds such as benzophenone, solvents such as white spirit and acetone, polyvinyl alcohols, etc., modified rosins, eg. Tacolyn 3179 from HERCULES, Permatac A751 from ALLIANCE TECHNICAL PRODUCTS (ATP) and Snowtac grades from AKZO NOBEL.

The method of the invention is also suitable in particular for the storage of high-viscosity products. The viscosities in this case are more than 500 mPas, preferably more than 5000 mPas and, particularly preferably, more than 7000 mpas.

The water content of the aqueous polymer dispersions is preferably from 20 to 80% by weight.

The dispersions may comprise (co)polymers in dispersed form. In this case they preferably include at least one monomer from the following monomer groups: (meth) acrylates, (meth)acrylic acid, butadiene, styrene, vinylidene chloride, acrylonitrile and vinyl acetate.

The aqueous dispersions preferably have a pH of more than 3, particularly preferably more than 5 and, very particularly preferably, more than 7.

In connection with the method of the invention it is advantageous to employ dispersions having a biocide concentration of less than 1000 ppm, preferably less than 50 ppm.

The method of the invention enables aqueous dispersions to be stored in a technically simple and economic manner. Advantageously, the excessive aging of parts of the stored dispersion is avoided and consequently a permanent high quality is ensured.

We claim:

1. A method of filling and emptying storage tanks containing aqueous dispersions having a water content of from 20 to 80% by weight, where the storage tank is emptied via a line whose opening is located in the lower section of the storage tank, which comprises filling the storage tank with a line, whose outlet follows the changes in the level of the liquid surface in the course of filling and removal procedures, the level of the outlet being adjusted such that the opening is located approximately at the height of the level of the liquid.

2. A method as claimed in claim 1, wherein unstirred storage tanks are used.

3. A method as claimed in claim 1, wherein single- or multi-joint float trunks are employed to fill the storage tank.

4. A method as claimed in claim 1, wherein the aqueous dispersions comprise (co)polymers in dispersed form which include at least one monomer selected from the following monomer groups: (meth)acrylates, (meth)acrylic acid, butadiene, styrene, vinylidene chloride, acrylonitrile and vinyl acetate.

5. A method as claimed in claim 1, wherein aqueous dispersions having a pH of more than 3 are employed.

6. A method as claimed in claim 5, wherein aqueous dispersions having a pH of more than 7 are employed.

7. A method as claimed in claim 1, wherein aqueous dispersions having a biocide concentration of less than 1000 ppm are employed.

8. A method as claimed in claim 7, wherein aqueous dispersions having a biocide concentration of less than 50 ppm are employed.

9. An apparatus for implementing the method as claimed in claim 1, comprising a storage tank (7) which contains a float trunk (2) that is connected to a filling line (1) and on whose end close to the outlet (5) a float is attached.

10. A method as claimed in claim 5, wherein aqueous dispersions having a pH of more than 5 are employed.

11. A method as claimed in claim 7, wherein aqueous dispersions having a biocide concentration of less than 100 ppm are employed.

* * * * *

UNITED STATES PATENT AND TRADEMARK OFFICE

CERTIFICATE OF CORRECTION

PATENT NO. : 5,971,036

DATED : October 26, 1999

INVENTOR(S) : Gerd REHMER et al.

It is certified that error appears in the above-identified patent and that said Letters Patent is hereby corrected as shown below:

On the title page, item [30], the Foreign Application Priority Data has been omitted. It should read as follows:

--[30] Foreign Application Priority Data

May 14, 1997 [GE] Germany.....197 20 070--

Signed and Sealed this

Nineteenth Day of December, 2000

*Attest:*

Q. TODD DICKINSON

*Attesting Officer*

*Commissioner of Patents and Trademarks*